US007031227B2

(12) United States Patent
Huter

(10) Patent No.: US 7,031,227 B2
(45) Date of Patent: Apr. 18, 2006

(54) DEVICE FOR DISPLAYING THE DAY OF THE MONTH

(75) Inventor: Marc Huter, Bienne (CH)

(73) Assignee: Richemont International S.A., Villars-Sur-Glane (CH)

( * ) Notice: Subject to any disclaimer, the term of this patent is extended or adjusted under 35 U.S.C. 154(b) by 290 days.

(21) Appl. No.: 10/407,169

(22) Filed: Apr. 7, 2003

(65) Prior Publication Data

US 2003/0193840 A1 Oct. 16, 2003

(30) Foreign Application Priority Data

Apr. 15, 2002 (CH) ..... 0623/02

(51) Int. Cl.
*G04B 19/24* (2006.01)

(52) U.S. Cl. ..... 368/37; 368/28; 368/35

(58) Field of Classification Search ..... 368/28, 368/31, 33–37

See application file for complete search history.

(56) References Cited

U.S. PATENT DOCUMENTS 6,081,483 A * 6/2000 Capt et al. ..... 368/28
6,574,167 B1 * 6/2003 Weissbach et al. ..... 368/35
6,738,316 B1 * 5/2004 Gabathuler et al. ..... 368/28

FOREIGN PATENT DOCUMENTS

| | | |
|---|---|---|
| CH | 644 238 | 7/1984 |
| CH | 689 601 | 6/1999 |
| EP | 0 529 191 | 3/1993 |

* cited by examiner

*Primary Examiner*—Kamand Cuneo
*Assistant Examiner*—Jeanne-Marguerite Goodwin
(74) *Attorney, Agent, or Firm*—Young & Thompson

(57) ABSTRACT

The device for displaying the day of the month comprises a units display member (1) and a tens display member (2) provided one with at least one series of numerals from 0 to 9 and the other with a series of numeral from 0 to 3, these units and tens display members being positioned relative to each other so as to display in the space of a large window two numerals side by side. The units display member (1) is divided into ten sectors or a multiple of ten sectors each carrying a numeral from 0 to 9, the nine sectors (a) separating the numerals 0–1, 1–2; . . . 8–9 having an angular extent equal to $4/5^{th}$ of the angular extent of the sectors (b) separating the numerals 9 from the numerals 0.

20 Claims, 1 Drawing Sheet

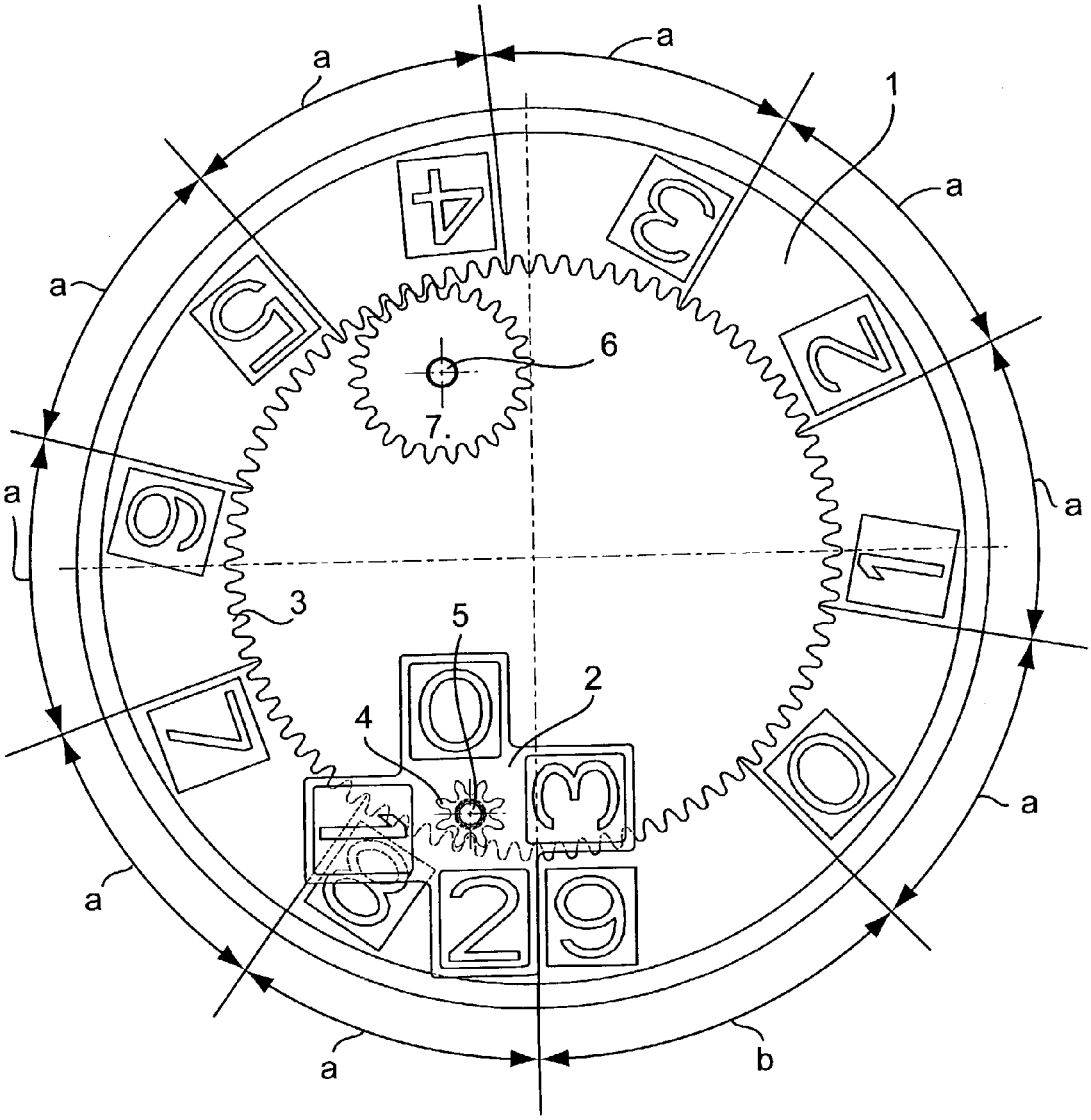
a
a
a
a
a
a
a
a
a
a
1
2
3
4
5
6
7
b

DEVICE FOR DISPLAYING THE DAY OF THE MONTH

The present invention relates to a device for displaying the day of the month, particularly for a timepiece of the type comprising a ring of units comprising numerals from 0 to 9 and a tens disc comprising numerals from 0 to 3, the day of the month being displayed in a large window by two numerals disposed side by side, one being carried by the units ring and the other by the tens disc. Such a device permits displaying the day of the month with numerals of large size which are thus easily readable.

Such displays of the day of the month are known from the patent EP0 529 191 or from Swiss patent 689,601 which both describe displays of the day of the month driven by a mechanical timepiece movement. The two known mechanisms for display of the days of the month are relatively complex and require several gear trains for driving respectively a units ring with several superposed years, which requires a large height size of these mechanisms.

The present invention has for its object the display of the day of the month for an electromechanical timepiece movement which will be simple, requiring few pieces, easy to machine, and having a reduced height and whose reading will be easy because of the large size of the numerals.

The only display of the day of the month known for an electromechanical watch movement is that described in Swiss patent 644,238, comprising a ring for the day of the month bearing the numeral from 0 to 31, driven stepwise with the help of a micromotor totally independently of the gearing of the watch. This device has the drawback of requiring the use of numerals of small size and hence difficultly readable and a ring of large diameter that can be disposed only at the periphery of the movement.

Another object of the present invention is to provide a simple, easily readable, display of the day of the month, which will be small in size, that can be easily used for an annular or perpetual date.

The present invention has for its object a display of the day of the month called "with a large window", avoiding the drawbacks of the existing devices, comprising a display member for units provided with at least one series of numerals from 0 to 9 and a tens display member comprising at least one series of numerals from 0 to 3, disposed relative to each other such that a numeral of each of these members can be displayed side by side in a window, these two units and tens members being driven directly one by the other, and which is distinguished by the characteristics set forth in claim 1.

The single FIGURE of drawing attached, illustrates schematically and by way of example an embodiment of a display of the day of the month according to the present invention.

The present display device of the day of the month is of the "large date" type, which is to say comprising a units member or ring 1 provided with a series of numerals 0 to 9 or a multiple of this series of numerals 0 to 9, and a tens member or disc 2 provided with numerals 0 to 3, or a multiple of this series of numerals 0 to 3, arranged so as to cause to appear side by side a numeral from the units ring 1 and a numeral from the tens disc 2 in a single large window of a timepiece face.

The display device which will be described in what follows can be included in any type of clock movement, mechanical, electrical or electromechanical, although it is particularly adapted for the latter.

The display device according to the invention as shown in the drawing is comprised by a units display member formed here by a ring of units 1 and a tens display number, here a tens disc 2.

The units ring 1 is provided with internal teeth 3 in engagement with a pinion 4 carried by the same pivot, and hence secured to the tens disc 2. This pinion 4 engages directly with the teeth 3 of the units ring 1.

This units ring 1 is divided into ten sectors each carrying a units numeral and thus forming a series of numerals from 0 to 9.

The sectors a bearing the numerals 0, 1, 2, 3, 4, 5, 6, 7 and 8 all have an arcuate length thus equal to an identical number of teeth of the internal teeth 3. The numeral 9 of the units ring is itself carried by a sector b of the units ring 1, sector b extending over a arc greater than that of sectors a and which hence comprises more teeth of the teeth 3 than sectors a.

In the illustrated example, each sector a of the units ring 1 comprises eight whilst the sector b of this ring 1 has ten. In this example, the pinion 4 of the tens disc comprises eight teeth, which is to say a number of teeth identical to that comprised by the sectors a of the units ring 1 bearing the numerals 0 to 8.

The tens disc 2, secured to the pinion 4, has in a uniformly distributed fashion about its circumference the numerals 0 to 3. This tens disc 2 is disposed such that one of the numerals that it bears can be disposed beside a numeral carried by the units ring 1 such that the two numerals can appear side by side in a same large window of a timepiece face (not shown).

The described display of the day of the month is driven by an electric micromotor controlled by electronic circuit, which micromotor drives either directly the axle 5 carrying the pinion 4 and the tens disc 2, or the axle 6 of a wheel 8 engaging with the internal teeth 3 of the units ring 1. In this latter case, the wheel 7 can comprise any number of teeth, for example equal to a whole multiple of that of the pinion 4 or of the sectors a.

The drive of the units ring 1 is caused preferably by the axle 5 of the pinion 4 but driving by the wheel 7 can be used for constructional reasons, or if the size of the micromotor could not directly drive the axle 5.

For correct operation of the described display device, it is necessary that when the units ring 1 is moved by the angular value corresponding to a sector a, the tens disc 2 carries out a whole number of complete turns and that when the units ring 1 is moved through an angular value corresponding to the sector b, the tens disc carries out a whole number turned plus a quarter turn. Thus, during passage of the units numerals 0 to 1, 1 to 2 . . . 7 to 8 and 8 to 9, the unit disc 2 carries out one turn and the numeral indicating the tenth remains the same. By contrast, during passage of the units numerals from 9 to 0, the tens disc 2 carries out one and a quarter turns such that the numeral of the disc disposed in the window beside a units numeral, is incremented by one unit.

Thus, in the case of a display comprising the same number of series of numerals 0 to 9 on the units ring 1 as the series of numerals from 0 to 3 on the tens disc 2, it is necessary that the number of teeth of the pinion 4 be equal to or a whole number multiple of the number of teeth which comprise the sectors a of the units ring 1, and that the sector b of this ring 1 comprise 1.25 times the number of teeth of the sectors a of this ring 1.

Generally speaking, the number of teeth of the sectors a and b of the units ring 1 and the number of teeth of the pinion 4 are such that when the units ring 1 carries out an angular movement corresponding to one of its sectors a, passage from a numeral 0 to 1; 1 to 2 . . . 8 to 9, the pinion 4 and hence the tens disc 1 carries out one complete turn or a whole number of complete turns. By contrast, for an angular movement of the units crown 1 corresponding to the sector b, passage from numeral 9 to zero, the tens disc 2 carries out one and a quarter complete revolutions, namely 5/4 of a revolution so as to give rise to the passage from one tens numeral to the following one, or n times 5/4 of a turn.

The micromotor (not shown) which drives the pinion 4 or the wheel 7 is programmed to advance this wheel 7 or pinion 4 by a value corresponding to the sector a, angular movement of the units ring 1 by one day to the next and of a sector b during passage of the tens. It is evident that the electronic control circuit of the micromotor can be provided to take account of the months of 28, 30 and 31 days, as well as the leap years or centuries. It is thus easy to provide a display of the day of the month which will be annual or perpetual.

In the case in which the micromotor directly drives the pinion 4 secured to the tens disc 2, it is controlled by its electronic control circuit so as to carry out one complete turn, namely 360° or eight teeth in the case shown of the pinion 4, from the first to the ninth day of each month. The tenth day of each month, the micromotor carries out 1.25 turns namely 450° or ten teeth of the pinion 4. Thus, during the nine first days of each month, the displayed tens numeral will remain the same, whilst the units numeral of the display day of the month is incremented by one unit, the units ring 1 being driven through an angular value of a sector a, namely by eight teeth in the example illustrated. The tenth day, the tens disc 2 carries out one and a quarter turns and the tens numeral displayed is incremented by one unit, whilst the units ring 1 is displaced by an angular value corresponding to the sector b, namely ten teeth in the illustrated example, and the units numeral displayed passes from 9 to 0. Then, from 10 to 19, the micromotor again drives the pinion 4 by one turn per day and then from 19 to 20 at one and a quarter turns. Then from the $20^{th}$ to the $29^{th}$ of a month, the micromotor again drives the pinion 4 by one turn per day and then from 29 to 30 by one and a quarter turns. The following days, the micromotor drives the pinion 4 by one turn and the day displayed is 31.

At the end of a month of 31 days, namely between 31 and the first of the following month, the micromotor carries out eight complete turns carrying the display of the day of the month to 39, then one and a quarter turns carrying this display to 00 and finally again one turn permitting displaying 01 in the window of the timepiece face.

In the case of a month of 30 days, the passage from 30 to 1 of the following month takes place as for the other tens as described above.

For the months of 28 days, the micromotor is driven at midnight on the $28^{th}$ by one complete turn followed by one and a quarter turns and then as for the months of 30 days.

Finally, for the months of 29 days, the micromotor is driven to midnight on the $29^{th}$ by one and a quarter turns followed by the procedure for the months with 30 days.

It is thus easy, by programming the micromotor with the help of a known control circuit, to provide an annual or perpetual calendar.

According to a modification, the units ring 1 could comprise several series of numerals 0 to 9, the sector b separating the numerals 9 and 0 of each series being equal to 5/4 of the extent of the arc of the sectors a separating the other numerals.

Numerous modifications of the display device are possible which all comprise a units ring provided with numerals 0 to 9 distributed in sectors of this ring, the sectors separating the numerals 0, 1 . . . 9 being of an arc length equal to $4/5^{th}$ of the sector separating the numerals 0 and 9 and a tens disc carrying out one or several turns per day except for moving up the tens, when it carries out one or several turns plus a quarter turn. Moreover, the tens disc is secured to a pinion which is directly in engagement with internal teeth or if desired external teeth of the units ring.

Such a construction requires a minimum of pieces, these pieces are easy to machine or produce and of low cost and the assembly is smaller. Moreover, the positioning of the tens disc, relative to the units ring, whose numerals are not necessarily disposed radially, permits selecting the place of the window as desired. Finally, the described display is not necessary concentric to the timepiece movement associated with it, but can be disposed moreover only at the periphery of this movement.

What is claimed is:

1. Device for displaying the day of the month, comprising a units display member (1) and a tens display member (2) provided one with at least one series of numerals from 0 to 9 and the other with a series of numerals from 0 to 3, these display members of the units and tens being positioned relative to each other so as to display in the space of a large window two numerals side by side, one carried by the units display member (1) and the other carried by the tens display member (2), characterized by the fact that the units display member (1) is divided into ten sectors or a multiple of ten sector each bearing a numeral from 0 to 9, the nine small sectors (a) separating the numerals 0–1; 1–2; . . . 8–9 having an angular extent equal to $4/5^{th}$ of the angular extent of the large sector (b) separating the numerals 9 from the numerals 0.

2. Device according to claim 1, characterized by the fact that the units display member is a ring (1) having internal or external teeth (3) engaging with a pinion (4) secured to the tens display member (2) formed by a disc.

3. Device according to claim 2, characterized by the fact that all the small sectors (a) of the units ring (1) correspond to a same number of teeth of the teeth (3) of this ring (1) and by the fact that this number of teeth corresponds also to the number of teeth of the pinion (4), whilst the number of teeth of the teeth (3) of the units ring (1) corresponding to the large sector (b) separating the numerals 9 and 10 is equal to 5/4 times the number of teeth corresponding to the small sectors (a).

4. Device according to claim 3, characterized by the fact that the tens disc (2) carries out a complete revolution when the units ring (1) moves angularly by the value corresponding to the display of 1 in the place of 0, of 2 in the place of 1 etc., of 9 in the place of 8 but that it carries out one and one quarter turn when the units ring (1) moves angularly by a value corresponding to the display from 0 in place of 9.

5. Display device according to claim 3, characterized by the fact that the pinion (4) and the tens disc (2) are driven in rotation.

6. Display device according to claim 3, characterized by the fact that the teeth (3) of the units ring (1) are also in engagement with the teeth of a wheel (7) driven in rotation.

7. Device according to claim 2, characterized by the fact that the tens disc (2) carries out a complete revolution when the units ring (1) moves angularly by the value corresponding to the display of 1 in the place of 0, of 2 in the place of 1 etc., of 9 in the place of B but that it carries out one and one quarter turn when the units ring (1) moves angularly by a value corresponding to the display from 0 in place of 9.

8. Display device according to claim 7, characterized by the fact that the pinion (4) and the tens disc (2) are driven in rotation.

9. Display device according to claim 7, characterized by the fact that the teeth (3) of the units ring (1) are also in engagement with the teeth of a wheel (7) driven in rotation.

10. Device according to claim 2, characterized by the fact that the tens disc (2) carries out a complete revolution when the units ring (1) moves angularly by the value corresponding to the display of 1 in the place of 0, of 2 in the place of 1 etc., of 9 in the place of 8 but that it carries out one and one quarter turn when the units ring (1) moves angularly by a value corresponding to the display from 0 in place of 9.

11. Display device according to claim 2, characterized by the fact that the pinion (4) and the tens display member (2) are driven in rotation.

12. Display device according to claim 2, characterized by the fact that the teeth (3) of the units ring (1) are also in engagement with the teeth of a wheel (7) driven in rotation.

13. Display device according to claim 12, characterized by the fact that the number of teeth of the wheel (7) is a whole number multiple of the number of teeth of the pinion (4).

14. Display device according to claim 2, characterized by the fact that the pinion (4) and the tens disc (2) are driven in rotation.

15. Display device according to claim 2, characterized by the fact that the teeth (3) of the units ring (1) are also in engagement with the teeth of a wheel (7) driven in rotation.

16. Device according to claim 2, characterized by the fact that the units ring (1) comprises a single series of numerals from 0 to 9 and that the tens disc (2) comprises a single series of numerals 0 to 3.

17. Device according to claim 16, characterized by the fact that all the small sectors (a) of the units ring (1) correspond to a same number of teeth of the teeth (3) of the units ring (1) and by the fact that this number of teeth corresponds also to the number of teeth of the pinion (4), whilst the number of teeth of the teeth (3) of the units ring (1) corresponding to the large sector (b) separating the numerals 9 and 10 is equal to ¾ times the number of teeth corresponding to the small sectors (a).

18. Device according to claim 16, characterized by the fact that the tens disc (2) carries out a complete revolution when the units ring (1) moves angularly by the value corresponding to the display of 1 in the place of 0, of 2 in the place of 1 etc., of 9 in the place of 8 but that it carries out one and one quarter turn when the units ring (1) moves angularly by a value corresponding to the display from 0 in place of 9.

19. Display device according to claim 16, characterized by the fact that the pinion (4) and the tens disc (2) are driven in rotation.

20. Display device according to claim 16, characterized by the fact that the teeth (3) of the units ring (1) are also in engagement with the teeth of a wheel (7) driven in rotation.

* * * * *